US005598252A

United States Patent [19]

Yamasa et al.

[11] Patent Number: 5,598,252

[45] Date of Patent: Jan. 28, 1997

[54] ELECTRONIC IMAGE FORMING APPARATUS WITH REDUCED RESIDUAL CARRIER AND TONER ATTRACTION

[75] Inventors: Hideo Yamasa, Ikoma; Fumio Shimazu, Chiba; Koichi Inui, Higashi-Osaka; Shirou Wakahara, Osaka; Yuuhi Yui, Nabari; Eiichi Kido, Yamato-Koriyama; Hiromu Yoshimoto, Yamabe-gun, all of Japan

[73] Assignee: Sharp Kabushiki Kaisha, Osaka, Japan

[21] Appl. No.: 500,597

[22] Filed: Jul. 11, 1995

Related U.S. Application Data

[62] Division of Ser. No. 77,988, Jun. 15, 1993, Pat. No. 5,459,555.

[30] Foreign Application Priority Data

Jun. 17, 1992 [JP] Japan ..... 4-157948

[51] Int. Cl.[6] ..... G03G 15/00

[52] U.S. Cl. ..... 399/46; 399/51; 399/206

[58] Field of Search ..... 355/219, 203, 355/208, 207, 246, 209

[56] References Cited

U.S. PATENT DOCUMENTS

| | | | |
|---|---|---|---|
| 3,707,138 | 12/1972 | Cartwright . | |
| 4,142,792 | 3/1979 | Satomi et al. . | |
| 4,312,589 | 1/1982 | Brannan et al. . | |
| 4,360,261 | 11/1982 | Kohyama . | |
| 4,477,179 | 10/1984 | Inuzuka et al. . | |
| 4,497,568 | 2/1985 | Komiya et al. . | |
| 4,504,139 | 3/1985 | Nozaki et al. . | |
| 4,714,942 | 12/1987 | Nakanishi | 436/122 |
| 4,790,557 | 11/1990 | Klingler . | |
| 4,814,816 | 3/1989 | Idenawa | 118/657 |
| 4,872,035 | 10/1989 | Miyake et al. | 355/208 |
| 4,922,293 | 5/1990 | Bando . | |
| 4,935,777 | 6/1990 | Noguchi et al. | 355/210 |
| 4,970,557 | 11/1990 | Masuda et al. | 355/246 |
| 5,041,865 | 8/1991 | Asano et al. . | |
| 5,091,743 | 2/1992 | Nagata et al. | 355/30 |
| 5,097,293 | 3/1992 | Seto et al. | 355/208 |
| 5,216,463 | 1/1993 | Morita . | |
| 5,267,000 | 11/1993 | Miyamoto et al. | 355/214 |

FOREIGN PATENT DOCUMENTS

| | | |
|---|---|---|
| 0428172A2 | 5/1971 | European Pat. Off. . |
| 0323226A2 | 7/1989 | European Pat. Off. . |
| 0400572A2 | 12/1990 | European Pat. Off. . |
| 0522812A2 | 1/1993 | European Pat. Off. . |
| 4000346A1 | 7/1990 | Germany . |
| 56-16155 | 2/1981 | Japan . |
| 59-105673 | 6/1984 | Japan . |
| 3-23471 | 1/1991 | Japan . |

*Primary Examiner*—Thu Anh Dang
*Attorney, Agent, or Firm*—David G. Conlin; Brian L. Michaelis

[57] ABSTRACT

An image forming apparatus provides a photosensitive body, a main charger, an exposing unit, developing unit and a contact-transfer charger. The main charger charges the photosensitive body with a predetermined electric potential. The exposing unit applies a laser beam on the surface of the photosensitive body to form an electric latent image. The developing unit develops the electrostatic latent image to form a toner image. The contact-transfer charger transfers the toner image on an image transfer paper. The image forming apparatus further provides controller for power supplies. The controller controls the power supplies after an image forming operation in a manner to enhance the electric potential of the photosensitive body to a high level by the main charger, drop the surface potential of the photosensitive body to a low level by the contact-transfer charger and then to cut off a bias voltage of the developing unit.

7 Claims, 10 Drawing Sheets

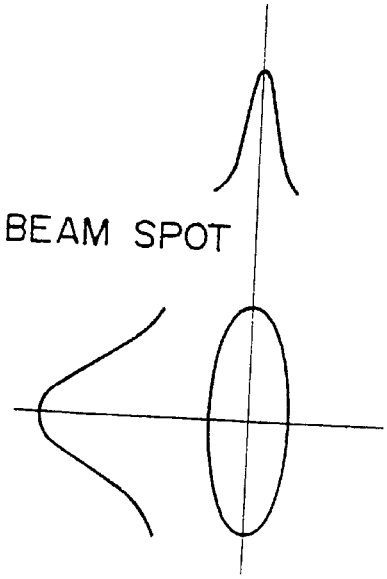
Fig. 6A
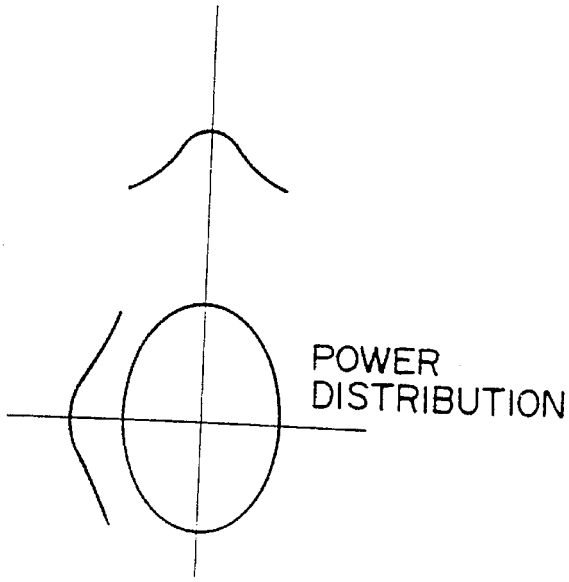
Fig. 6B
Fig. 7
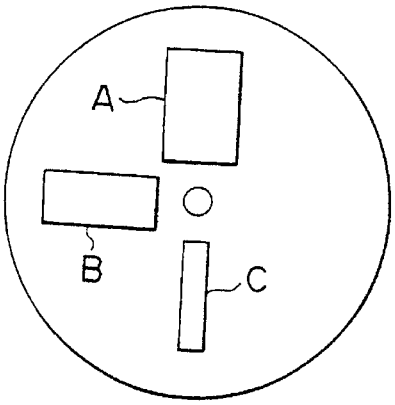

ELECTRONIC IMAGE FORMING APPARATUS WITH REDUCED RESIDUAL CARRIER AND TONER ATTRACTION

This is a divisional of U.S. patent application Ser. No. 08/077,988 filed on Jun. 15, 1993, now U.S. Pat. No. 5,459,555.

BACKGROUND OF THE INVENTION

1. Field of the Invention

The present invention relates to an electronic image forming apparatus for forming an image or a character on a paper.

2. Description of the Related Art

In the conventional electronic photographic apparatus, for example, as shown in FIG. 13, a laser beam 33 applied from an exposing unit (not shown) serves to expose the surface of a photosensitive body 31 charged with a predetermined electric potential by a charger 32, for forming an electrostatic latent image according to an electric potential difference between an exposed portion where an electric potential is made lower and an unexposed portion where an electric potential is not made lower.

This electrostatic latent image is developed to be a toner image by a developing unit 34. This toner image is transferred to an image transfer paper 35 fed from a paper feeding unit (not shown) by a transfer charger 36. Then, the image transfer paper 35 on which the toner image is transferred is subject to a fixing process done by a fixing unit (not shown) and then is ejected out of the apparatus.

On the other hand, toner left on the surface of the photosensitive body 31 after doing the transfer process is stripped off the surface of the photosensitive body 31 by a cleaning unit 37. The residual electric potential on the surface of the photosensitive body 31 is removed by a discharging lamp 38. Then, the operation goes to the next cycle.

The removal of the residual electric potential on the photosensitive body 31 after terminating the image transferring process by the discharging lamp 38 is an essential step. Except this discharging step, the electric potential on the photosensitive body 31 is going up by repetitively charging the electric potential on the surface by a Scorotoron charger 32. This results in bringing about insulation breakdown of the photosensitive body by the excessive charges charged on the photosensitive body 31.

Further, even when a discharging lamp or a ray of light for writing is used, the foregoing discharging needs to constantly light on the lamp for abruptly lowering the electric potential on the surface of the photosensitive body 31.

On the other hand, provision of a leased discharging unit like the discharging lamp 38 is a cause of inhibiting reduction and cost down of the unit. Hence, the arrangement providing no leased discharging unit, for example, an arrangement for doing discharge by a transfer charger has been proposed in the publication of Japanese Lying Open No. Showa 56-16155 or an arrangement for dividing a laser beam applied from the exposing unit and discharging the photosensitive body 31 by this laser beam.

However, the foregoing conventional arrangements do not overcome a shortcoming specific to a reversal developing system using two-component developing powder, that is, carrier or toner attraction on the photosensitive body 31 after forming an image. This shortcoming is an obstacle to forming an excellent image.

To overcome this shortcoming, as disclosed in the publication of Japanese Patent Lying Open No. Hei 3-23471, an electronic photography apparatus has been proposed to provide control means for controlling a power supply in a manner to switch off a developing bias voltage of the developing unit after applying such a voltage as enhancing the potential on a photosensitive body to a predetermined high level onto a main charger, applying such a voltage as dropping the potential on a photosensitive body to a low level onto a contact-transfer charger, and applying such a voltage as charging the surface of the photosensitive body with the electric potential level at which carrier attraction is inhibited, and exposing unit control means for operating an exposing unit in a manner to lower the electric potential on the surface of the photosensitive body up to a ground potential by means of a ray of light applied from the exposing unit.

In the conventional arrangement as disclosed in the Japanese Lying Open No. Hei 3-23471, no problem takes place if the contact-transfer charger is a non-contact type such as a Scorotoron type but the following problem takes place if it is a contact type like a transfer roller type.

After switching off the developing bias voltage, a slight amount of toner is attracted on the photosensitive body of the developing unit through an edge effect in the border (area immediately after the laser beam is switched on) when the surface potential of the photosensitive body is lowered to a value near the ground potential by means of a beam applied from the exposing unit.

In the case of a non-contact transfer type, a slight amount of toner on the photosensitive body is cleaned by a cleaning unit. In the case of a contact transfer type like a transfer roller type, the toner on the photosensitive body is attracted on the transfer roller so that dirt may be unfavorably printed on the rear surface of the image transfer paper.

If the surface potential is made lower, it is difficult to cut off the developing bias voltage in the state that the surface potential is completely matched to the bias as shown in FIG. 14. In actual, normally, both of the potential and the voltage may be slightly slipped as shown in FIGS. 15-2 and 15-3. In the case shown in FIG. 15-2, the disadvantage such as carrier attraction takes place. In the case shown in FIG. 15-3, the disadvantage such as toner attraction takes place. The occurrence of such disadvantages are known if the two-component system developing agent is used. This disadvantage brings about reduction of the developing agent or increase of a consumed amount of the developing agent.

In the case of using a contact member such as a transfer roller as a transfer member, the carrier attraction leads to impairing the photosensitive body, because the photosensitive body is laid between the transfer member and the photosensitive body. The toner attraction causes the toner to be attracted on the transfer member, which leads to a cause of dirt on the rear of the paper at the next print.

The present invention makes it possible to solve the foregoing disadvantages and supply an excellent print or copy with no dirt on the rear of an image transfer paper even in a contact-transfer system.

SUMMARY OF THE INVENTION

It is therefore an object of the present invention to provide an electronic image forming apparatus which is capable of supplying an excellent print or copy with no dirt on the reverse side of an image transfer paper even in a contact-transfer system.

The object of the invention can be achieved by an electronic image forming apparatus comprising a image forming steps of charging the surface of a photosensitive body with a predetermined electric potential by means of a main charger, exposing the surface of the photosensitive body with a laser beam applied from an exposing device for forming an electrostatic latent image, developing the electrostatic latent image by a developing unit for forming a toner image, and transferring the toner image on an image transfer paper by a contact-transfer charger, the electronic image forming apparatus is characterized by providing a power supply unit for feeding a power to each of the main charger, the developing unit and the contact-transfer charger and means for controlling the power supply unit in a manner to enhance the electric potential of the photosensitive body to a high level by the main charger, drop the surface potential of the photosensitive body to a low level by the contact-transfer charger and then to cut off a bias voltage of the developing unit, a temperature sensor for sensing a temperature of the inside of the apparatus itself and means for controlling a strength of a laser beam to a predetermined value fired from the exposing unit according to the temperature sensed by the temperature sensor.

In the electronic image forming apparatus according to the first aspect of the invention, the power supply is controlled by the voltage output control means, based on the voltage timing sensed by the sensing means after forming an image.

Hence, at first, the potential on the photosensitive body is uniformly kept at a predetermined high level by the main charger. The photosensitive body is reversely charged by the contact-transfer charger so that the surface potential may be lowered to a low level. The surface potential on the photosensitive body is charged at such a potential as inhibiting the carrier attraction by the main charger. Then, the developing bias voltage of the developing unit is switched off. At a time, the surface potential on the photosensitive body is pre-set to such a potential as inhibiting the carrier attraction. Hence, the carrier or toner attraction on the photosensitive body caused by switching off the developing bias is not brought about.

In a second aspect of the invention, there is provided an electronic image forming apparatus comprising a image forming steps of charging the surface of a photosensitive body with a predetermined potential by a main charger, exposing the surface of the photosensitive body with a laser beam applied from an exposing unit for forming an electrostatic latent image, and developing the electrostatic latent image by a developing unit for forming a toner image, and transferring the toner image on an image transfer paper by a contact-transfer charger, the electronic image forming apparatus is characterized by providing means for lowering the electric potential of the surface of the photosensitive body by applying to the photosensitive body the laser beam having a strength regulated by changing a focal distance of the laser beam and/or a slit area of a plate through which the laser beam passes, after cutting off a bias voltage of the developing unit after forming an image.

In the electronic image forming apparatus according to the second aspect of the invention, after switching off the developing bias, based on the operating timing of the exposing unit sensed by the sensing means, the exposing unit control means and the power control means control the operation of the exposing unit. The photosensitive body is partially discharged by the power-controlled beam fired from the exposing unit. Then, the normal image-exposing power is fired to uniformly lower the apparatus to the surface potential of the photosensitive body or the ground potential.

In a third aspect of the invention, there is provided an image forming apparatus arranged to take an image forming steps of charging the surface of a photosensitive body with a predetermined electric potential, exposing the surface of the photosensitive body by a laser beam applied from an exposing unit for forming an electrostatic latent image, developing the electrostatic latent image by a developing unit for forming a toner image, and transferring the toner image on an image transfer paper by a contact-transfer charger, the electronic image forming apparatus is characterized by providing means for lowering an electronic potential on the surface of the photosensitive body by applying a laser beam obtained by switching on and off the exposing unit at predetermined intervals after cutting off a bias voltage of the developing unit after forming an image.

According to an electronic image forming apparatus according to the third aspect of the invention, after switching off the developing bias, based on the operating timing of the exposing unit sensed by the sensing means, the exposing unit control means serves to control the operation of the exposing unit so as to switch on and off the laser beam fired from the exposing unit at predetermined intervals. This laser beam operates to partially discharge the photosensitive body. Then, the normal image-exposing power serves to lower the surface potential on the photosensitive body to a value near the ground potential. Since the beam fired from the exposing unit is weakened in power in the border area, the attraction of slight tone is not brought about through the edge effect specific to an electronic photography.

If the photosensitive body is stopped in such a state, since the surface potential on the photosensitive body is removed, no degrade of the photosensitive body resulting from the residual potential is brought about.

The electronic image forming apparatus according to the present invention is capable to reducing the apparatus in size by removing a leased discharging unit and lower the cost and which offers the effect of preventing the carrier attraction on the photosensitive body and the toner attraction on the contact-transfer charge caused when the photosensitive body is stopped after terminating an image forming operation.

Further objects and advantages of the present invention will be apparent from the following description of the proffered embodiments of the invention as illustrated in the accompanying drawings.

BRIEF DESCRIPTION OF THE DRAWINGS

FIG. 6 is a view standing for a relation between a form of a spot and a power distribution of the laser beam shown in FIG. 3.

FIG. 7 is a view showing three kinds of different slits formed on a circular plate for adjusting a beam power according to an embodiment of the second invention.

DESCRIPTION OF THE PREFERRED EMBODIMENT

Figure 1:
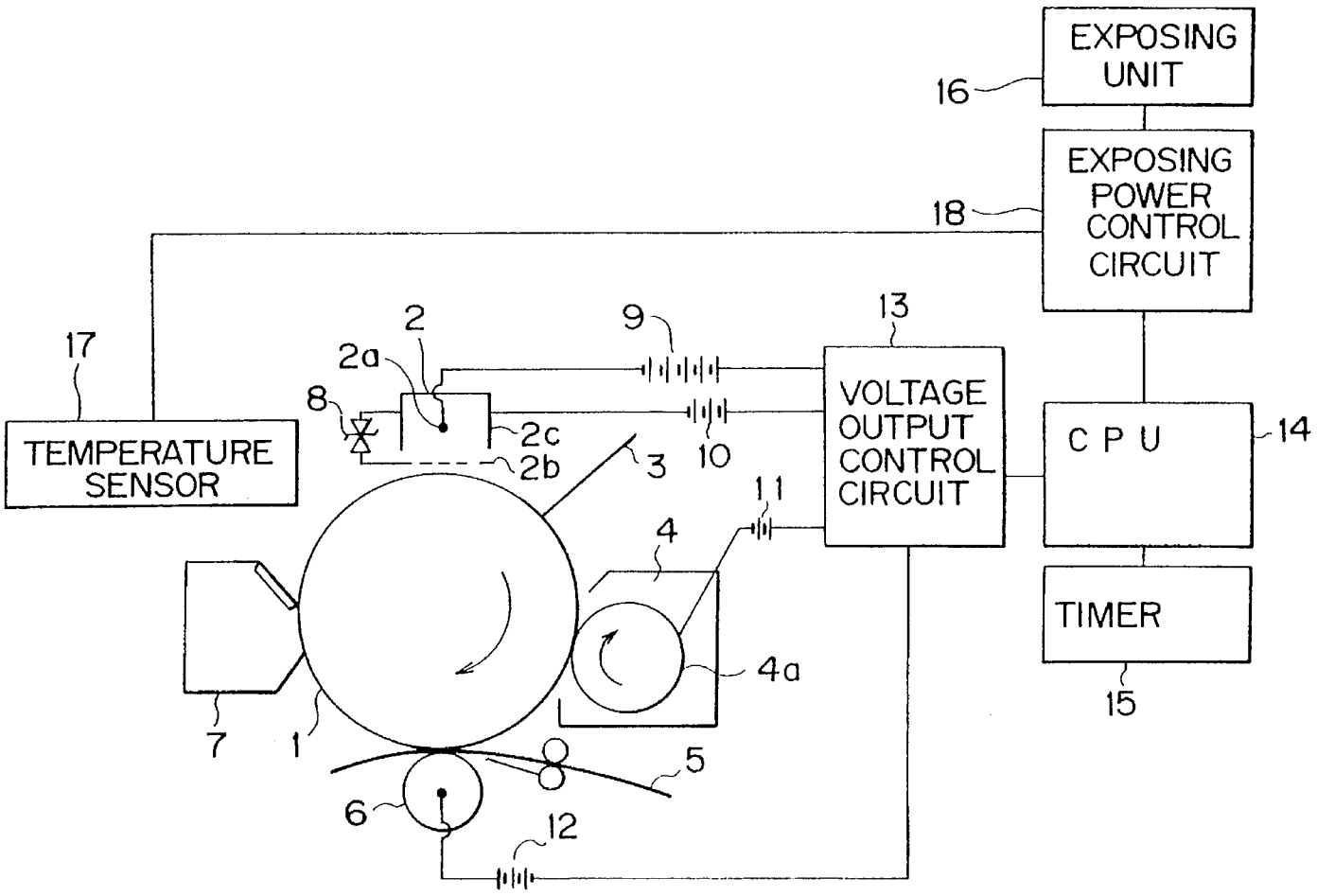
FIG. 1 is a view showing functional blocks of an electronic image forming apparatus according to an embodiment of the present invention.

FIG. 1 shows an embodiment of the first invention. The main functional part of an electronic photography apparatus is represented in a block diagram. This electronic photography apparatus provides a Scorotron charger 2 served as a main charger for charging the surface of a photosensitive body 1 with a predetermined potential and a developing magnet roller (referred to as "MG roller") 4*a* around the photosensitive body 1. The apparatus further provides a developing unit 4 for developing an electrostatic latent image formed on the photosensitive body 1 by a laser beam 3 fired from an exposing unit (not shown), a contact-transfer charger 6 for transferring onto an image transfer paper 5 a toner image formed on the surface of the photosensitive body 1 by the development of the developing unit 4, and a cleaning unit 7 for removing toner left on the surface of the photosensitive body 1 after terminating the image transfer.

The Scorotron charger 2 includes a charger 2*a* for feeding charges to the photosensitive body 1 for charging the photosensitive body 1, a control grid 2*b* for controlling an electric potential of the photosensitive body 1 provided between the electrode 2*a* and the photosensitive body 1, and a metallic case 2*c*. As shown in FIG. 1, the control grid 2*b* is connected to the metallic case 2*c* through a bidirectional Zener diode 8. The Zener diode 8 serves to keep the potential difference between the control grid 2 and the case 2*c* at a constant value under the lower voltage than a predetermined value. The polarity of the control grid 2*b* is the same as that of the corona voltage applied by the electrode 2*a*. The voltage of the control grid 2*b* is constantly set to several hundreds volts. By adjusting this voltage, the necessary potential is applied on the photosensitive body 1. The electrode 2*a* of the Scorotron charger 2 is connected to a cathode of the power supply 9. The cathode of the power supply 10 is connected to the metallic case 2*c*. The MG roller 4*a* of the developing unit 4 is connected to the cathode of the power supply 11. The electrode of the contact-transfer charger 6 is connected to the anode of the power supply 12. The anodes of the power supplies 9 to 11 and the cathode of the power supply 12 are connected to a voltage output control circuit 13 for controlling an output voltage of these power supplies 9 to 12. This voltage output control circuit 13 is connected to a power control unit (referred to as "PCU") 14. The PCU 14 is connected to a timer 15 and an exposing unit 16 served as related means.

The timer 15 operates to count a predetermined time for controlling the power supplies 9 to 12 and a predetermined time for controlling an operation of the exposing unit. The PCU 14 operates to control the operation of the voltage output control circuit 13 and the exposing unit 16, based on the control timing counted by the timer 15. The PCU 14 composes the voltage control means together with the voltage output control circuit 13 or exposing unit control means. The voltage output control circuit 13 operates to control the output voltages of the voltage supplies 9 to 12 on a predetermined timing counted by the timer 15, based on a control signal of the PCU 14. The exposing unit 16 operates to fire laser beam 3 for exposing the photosensitive body 1. The laser strength may be switched.

As means for switching a laser strength, various kinds of sensors such as a temperature sensor 17 is installed inside of the apparatus for the purpose of controlling the laser strength of the exposing unit 16 based on the detected data.

Figure 2:
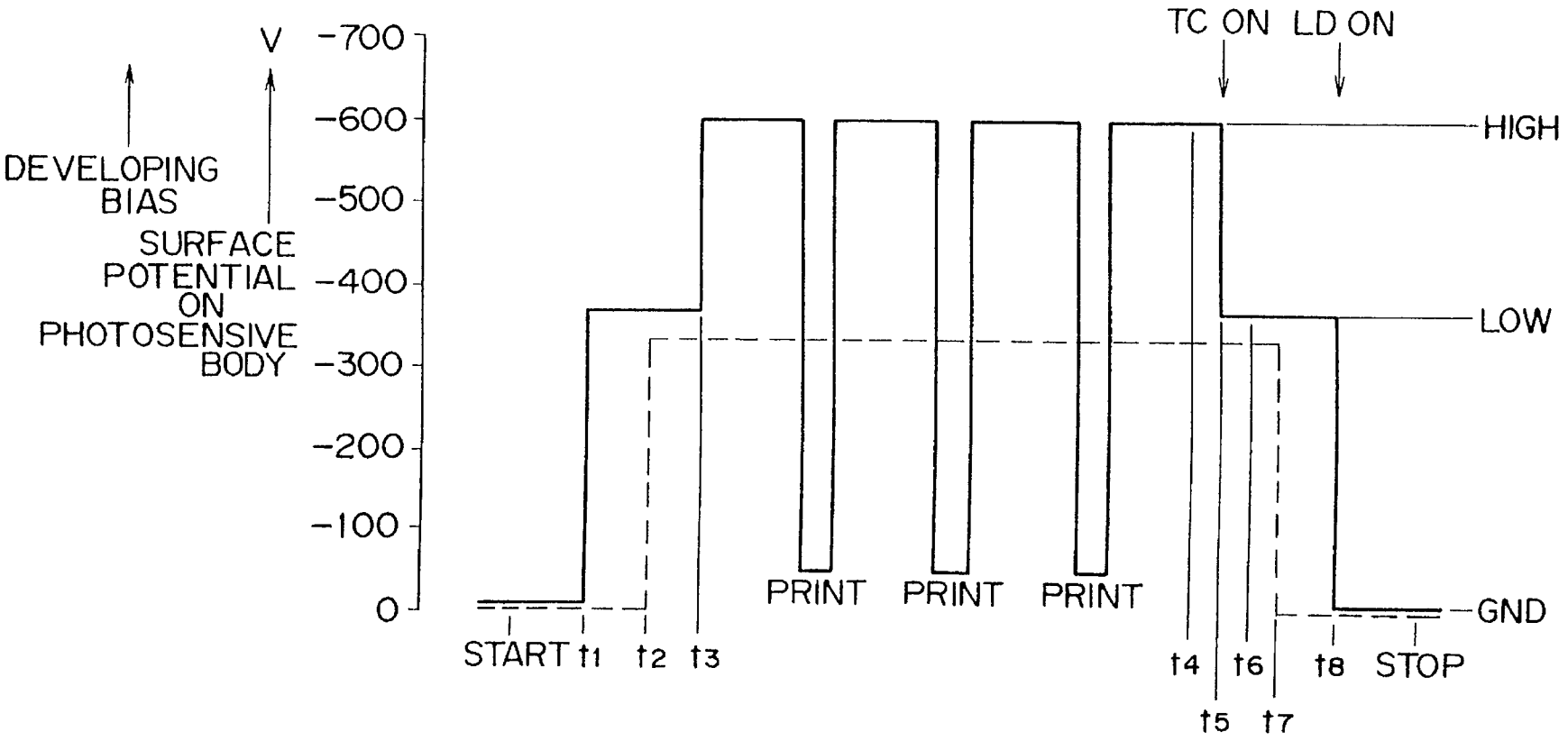
FIG. 2 is a view showing a relation between a surface potential of the photosensitive body and a developing bias.

FIG. 2 shows the timing on which the electronic photography apparatus arranged as described above operates. When forming an image, at first, the rotation of the photosensitive body 1 is started. Next, as shown in FIG. 2, the timer 15 counts a time point t1. Then, in response to a command of the PCU 14, the voltage output control circuit 13 is operated so that the first power supply 9 may feed a predetermined voltage to the electrode 2*a* of the Scorotoron charger 2 and the second power supply 10 may feed such a voltage as keeping the potential of the photosensitive body 1 at low level to the case 2*c*, that is, the control grid 2*b*, thereby lowering the electric potential of the photosensitive body 1. Then, at a time t2, the third power supply 11 may apply a developing bias voltage for the development of the MG roller 4*a*. Further, at a time point t3, such a voltage as keeping the potential of the photosensitive body 1 at high level is fed from the second power supply 10 to the control grid 2*b*, thereby keeping the potential of the photosensitive body 1 at high level.

In the process of charging the photosensitive body 1, when the photosensitive body 1 keeps its potential low, the charges from the Scorotron charger 2 is mainly fed to the photosensitive body 1 for charging it. On the other hand, when the potential on the photosensitive body 1 comes closer to the potential on the control grid 2*b*, the charges from the Scorotron charger 2 are mainly fed to the control grid 2*b*. A certain relation is constantly kept between the potential on the photosensitive body 1 and the potential on the control grid 2*b*. By controlling the potential of the control grid 2*b*, it is possible to control the electric potential of the photosensitive body 1. Hence, the potential of the photosensitive body 1 is constantly kept at a constant potential. This relation makes it possible to continue the formation of an image.

When the surface potential on the photosensitive body 1 is at high level, the laser beam 3 fired from the exposing unit 16 is applied to the surface of the photosensitive body 1 being rotated, resulting in lowering the potential of the laser beam applied part through the effect of light attenuation. This results in forming the electrostatic static latent image on the surface of the photosensitive body 1. This electrostatic latent image is made to be a toner image developed by the toner fed from the MG toner 4*a* of the developing unit 4. Then, when the toner image comes into contact with the contact charger 6 after the photosensitive body 1 is further rotated, the image transfer paper 5 is fed from the paper feeding unit (not shown) in synchronous to the rotation of the photosensitive body 1 so that the toner image on the surface of the photosensitive body 1 may be transferred onto the image transfer paper 5 by the contact-transfer charger 6 to which a predetermined voltage is fed from the fourth power supply 12. After terminating this transfer process, the toner left on the surface on the photosensitive body 1 is stripped off the surface of the photosensitive body 1 by the cleaning unit 7 and is recovered. At a time when the photosensitive body 1 passes through the cleaning unit 7, the electrostatic latent image is still left on the surface of the photosensitive body 1. However, at the next cycle, the surface of the photosensitive body 1 is uniformly recharged by the Scorotron charger 2. Further, the image transfer paper 5 on which a toner image is transferred passes through the fixing process by a fixing unit (not shown) and is ejected out of the apparatus.

After forming an image, at a time point t4, such a voltage as enhancing the potential of the photosensitive body 1 to a high level is fed to the control grid 2*b* and the potential on the photosensitive body 1 is uniformly kept at high level by the Scorotron charger 2. Then, at a time point t5, the surface of the photosensitive body 1 needs such a voltage level as inhibiting the carrier attraction. No special control is not required for output of the power supply 12 of the contract-transfer charger 6. Then, at a time point t6, the surface of the reversely charged photosensitive body 1 is charged with such a potential as inhibiting the carrier attraction by the Scorotron charger 2. That is, the surface is made lower. Like the foregoing case, at this time, the operation is done by controlling the output voltage of the power supply 10 added to the control grid 2*b*. After than, at a time point t7, the developing bias voltage applied onto the developing magnet roller 4*a* is switched off. At a time, the potential on the photosensitive body 1 is set to such a potential as inhibiting the carrier attraction, that is, a low level. Hence, if the developing bias is switched off, no carrier is attracted on the photosensitive body 1. Further, no toner attraction on the photosensitive body 1 takes place. Then, at a time point t8, with the laser beam from the exposing unit 16 for exposure, for one embodiment, a weak power is given, while for another embodiment, a halftone image ray is given with one line being on and another line being off for discharging the surface potential on the photosensitive body 1 to a middle point between the low level and the ground potential. Then, the laser beam 3 is emitted to the photosensitive body 1 with the same power as the normal image exposure for discharging the surface potential on the photosensitive body 1 to a value near the ground potential. After that, the photosensitive body 1 is stopped. At this time, since the surface potential on the photosensitive body 1 is discharged, no degrade of the photosensitive body 1 resulting from the residual potential is brought about. It is desirous that the power-controlled laser beam may be a half reduced exposure E1/2 to E. The optimum laser power given for the normal image exposure may be desirously 3 to 5 times as large as E1/2.

As reference data for controlling a laser strength, a temperature sensor 17 is provided inside of the apparatus so as to measure the temperature inside of the apparatus (drum temperature) and control the laser strength of the exposing unit 16 to be the most approximate power by the exposure power control circuit 18. Various kinds of reference data are provided for controlling a laser strength. For example, a timer for a leaving time is installed inside of the apparatus for monitoring a printing frequency or a leaving time (waiting or a power off). The exposure power control circuit 18 serves to control the laser strength of the exposing unit 16 to the most approximate power based on the monitor data. The detection sensor serves to monitor a pattern (printing area) to be printed as a printing factor integrator so as to control the laser strength of the exposing unit 16 to the most approximate power. Concretely, for example, the laser strength is made weaker when printing black on the overall surface of the paper and is made stronger when printing white on the overall surface. As another kind of reference data, a switching circuit is provided according to a drum manufacture lot or a drum life (number of possible papers to be printed). The laser strength of the exposing unit 16 may be set to the most approximate power through the effect of the exposure power control circuit 18. This switching setting may be setting of initial values. It means that another kind of data may be used for this setting.

Figure 3:
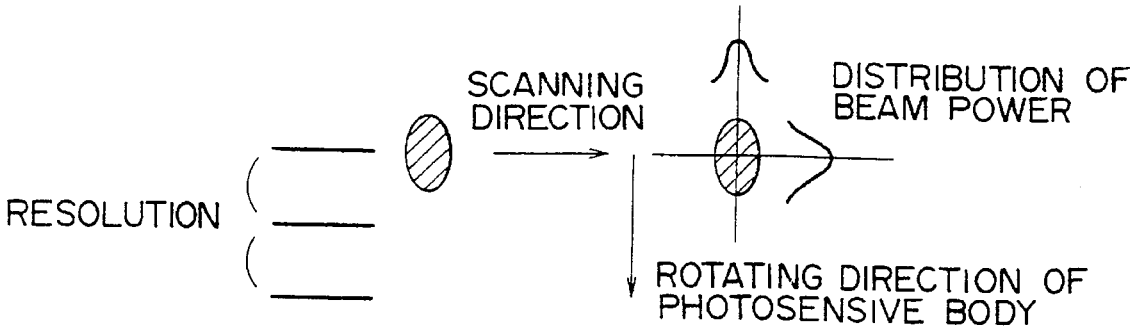
FIG. 3 is a concept view showing a scanning operation of a laser beam used in the embodiment of the second invention.
Figure 4:
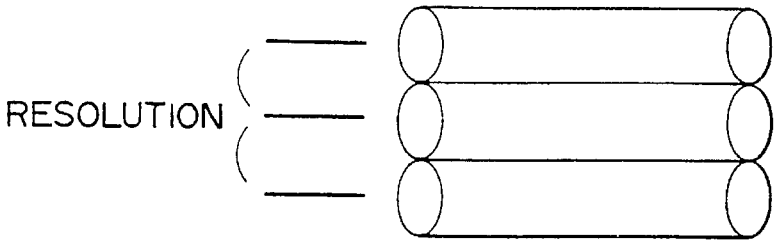
FIG. 4 is a view showing a first example of an exposure to be done by a laser beam shown in FIG. 3.
Figure 5:
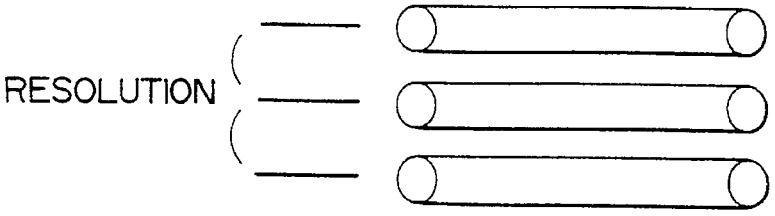
FIG. 5 is a view showing a second example of an exposure to be done by a laser beam shown in FIG. 3.

The embodiment of the second invention will be described below. This embodiment concerns with adjustment of a strength of a laser beam fired onto the photosensitive body 1 at a time point t8. FIGS. 3 to 7 shows a routine for switching a laser strength. As shown in FIG. 3, the laser printer operates to scan an elliptical beam spot in a manner to achieve a predetermined resolution through the effect of a polygon mirror (not shown). If the scan pitch is equal to or lower than the width of a beam spot, on the photosensitive body as shown in FIG. 4, the beam spots are overlapped for uniform exposure. However, since the form of a beam is also changed if the laser power is simply controlled, if the power is made weaker, the laser beam unfavorably gives a striped exposure on the photosensitive body as shown in FIG. 5. In this embodiment, to solve this unfavorable situation, the beam form is controlled at a time when the laser power is controlled. The distribution of a beam power when controlling the power is shown in FIG. 6. If the focal depth of a beam is a value from FIG. 6-1 to FIG. 6-2, the beam spot is made expanded so that the power distribution on the photosensitive body is made weaker.

More concrete method will be shown. A general laser unit is arranged to select a semiconductor laser through a slit and fire the laser onto a polygonal mirror, pass through an Fq, condense the light, and adjust a focal point of the condensed light on the photosensitive body through a mirror. Hence, as described above, to expand a beam, it is necessary to misadjust the focal point. That is, by changing the slits and the Fq lens, it is possible to easily expand the beam. For example, the embodiment in which the slits are changed is shown in FIG. 7. The slits are opened on a circular plate with their corresponding sizes. The circular plate may be rotated on the center. Normally, the B slit shown in FIG. 7 is a standard slit. The use of an A slit has an effect on strengthening the laser power. The use of a C slit has an effect on weakening it more. It goes without saying that the combination of changing the laser power itself with the use of the slits makes it possible to vary the laser power to two or more values. This embodiment uses the slits. The misadjust of the Fq lens may offer the same effect.

Figure 8:
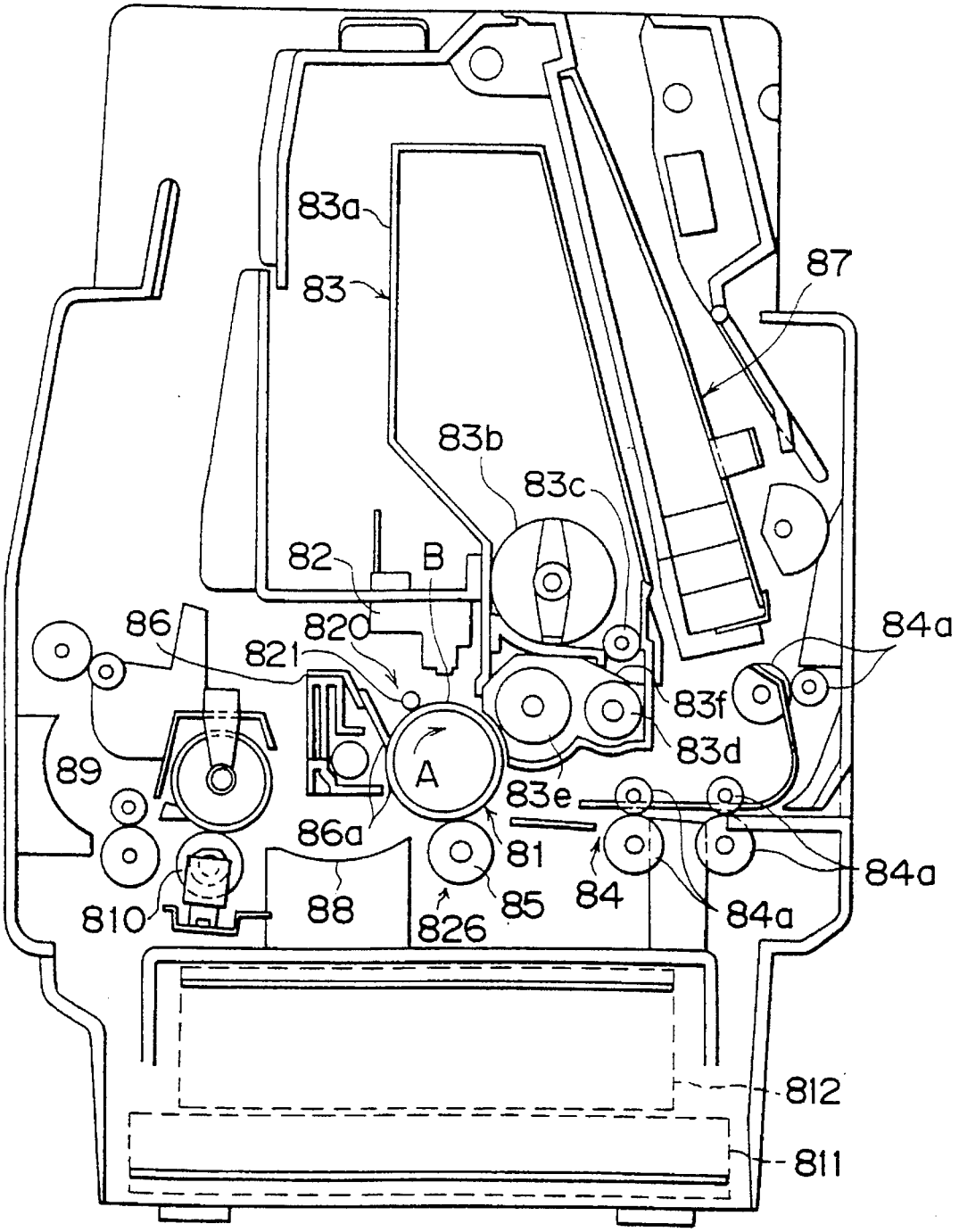
FIG. 8 is a view showing an equipment arrangement of a side of a laser printer according to an embodiment of the third invention.

The embodiment of the third invention will be discussed below. The printer included in this embodiment, as shown in FIG. 8, provides a photosensitive body 81, which is allowed to rotate in the A direction. Around the photosensitive body 81, there are located a charging unit 820, an LED head 82, a developing unit 83, a feeding and conveying path 84, a transfer unit 826 and a cleaning unit 86.

The charging unit 820 includes a charging roller 821. This charging roller 821 is provided in contact with the photosensitive body 81 so that the roller 821 is rotated as following the A-directional rotation of the photosensitive body 81. The LED head 82 operates to emit a ray of light R corresponding to the image to be formed on an exposure point B on the photosensitive body 81 for exposing the photosensitive body 81. The developing unit 83 provides a toner tank 83*a*, an agitator roller 83*b*, and a supply roller 83*c* and feeds toner to a developing bath 83*f* having a mixer roller 83*d* and a magnet roller 83*e*. Then, the toner in the developing bath 83*f* is mixed and stirred with carrier (not shown) by the mixer roller 83*d*. The mixed material is transferred and fixed on the electrostatic latent image on the photosensitive body 81 through the effect of the magnet roller 83*e* and then the image is developed. The feeding and conveying path 84 has one end located near a pressurized portion between the photosensitive body 81 and a transfer roller 85 to be described later and the other end located near a paper cassette 87. In the feeding and conveying path 84, a plurality of supply rollers 84*a* are properly dispersed. The transfer unit 836 provides the transfer roller 85, which is pressurized on the photosensitive body 81. The cleaning unit 86 provides a cleaning blade 86*a* which comes into contact with the photosensitive body 81.

In the feeding direction of the paper conveyed from the photosensitive body 81, there are located an ejecting path 88, a heat roller 89 and a pressure roller 810, both of which are pressurized on each other. The printed paper on which a toner image is transferred by the transfer roller 85 is conveyed through the ejecting path 88 and between the heat roller 89 and the pressure roller 810. Between these rollers, the printed paper is heated and pressurized for fixing a toner image on the printed paper.

In the downward side of this printer, the controller 811 and the engine controller 812 are located. In response to a signal from a host computer (not shown), an image signal and a printer engine control signal, the controller 811 executes engine control for controlling the operation of each of the above means.

Figure 9:
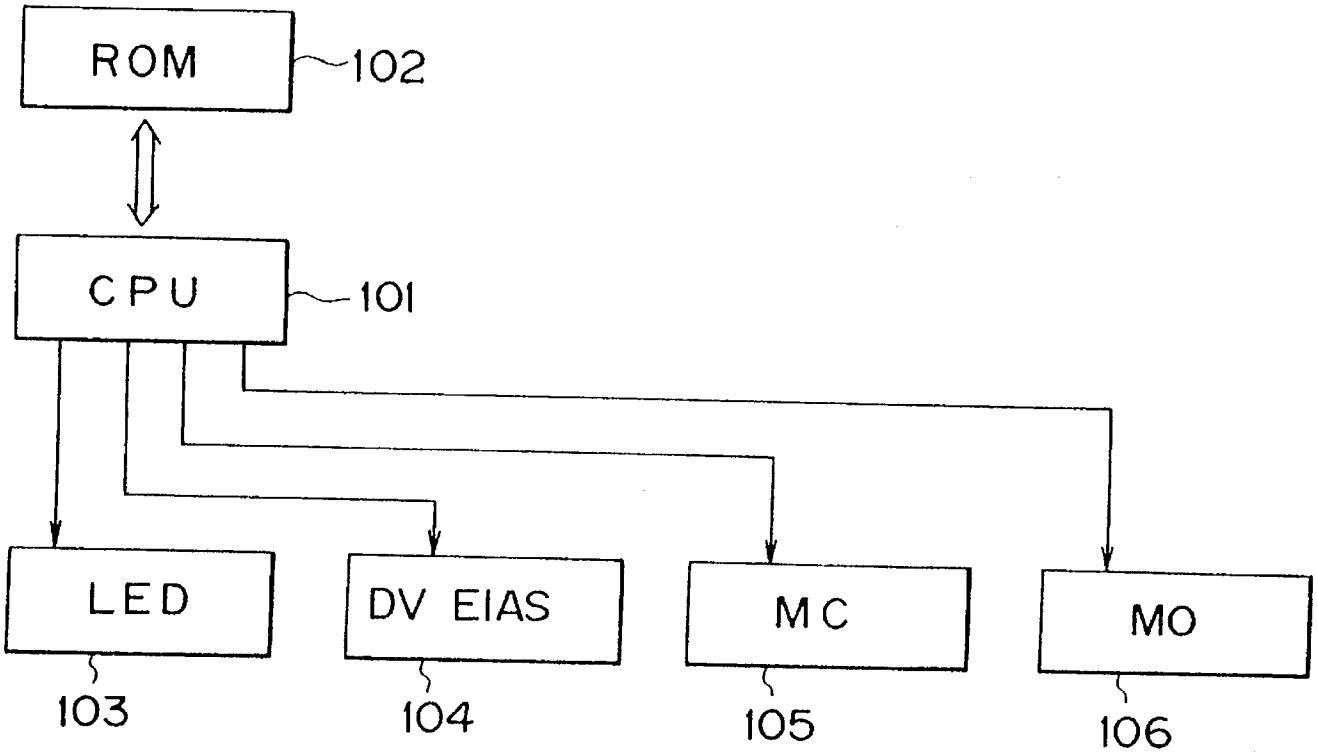
FIG. 9 is a flowchart showing a control signal of the laser beam shown in FIG. 8.
Figure 10:
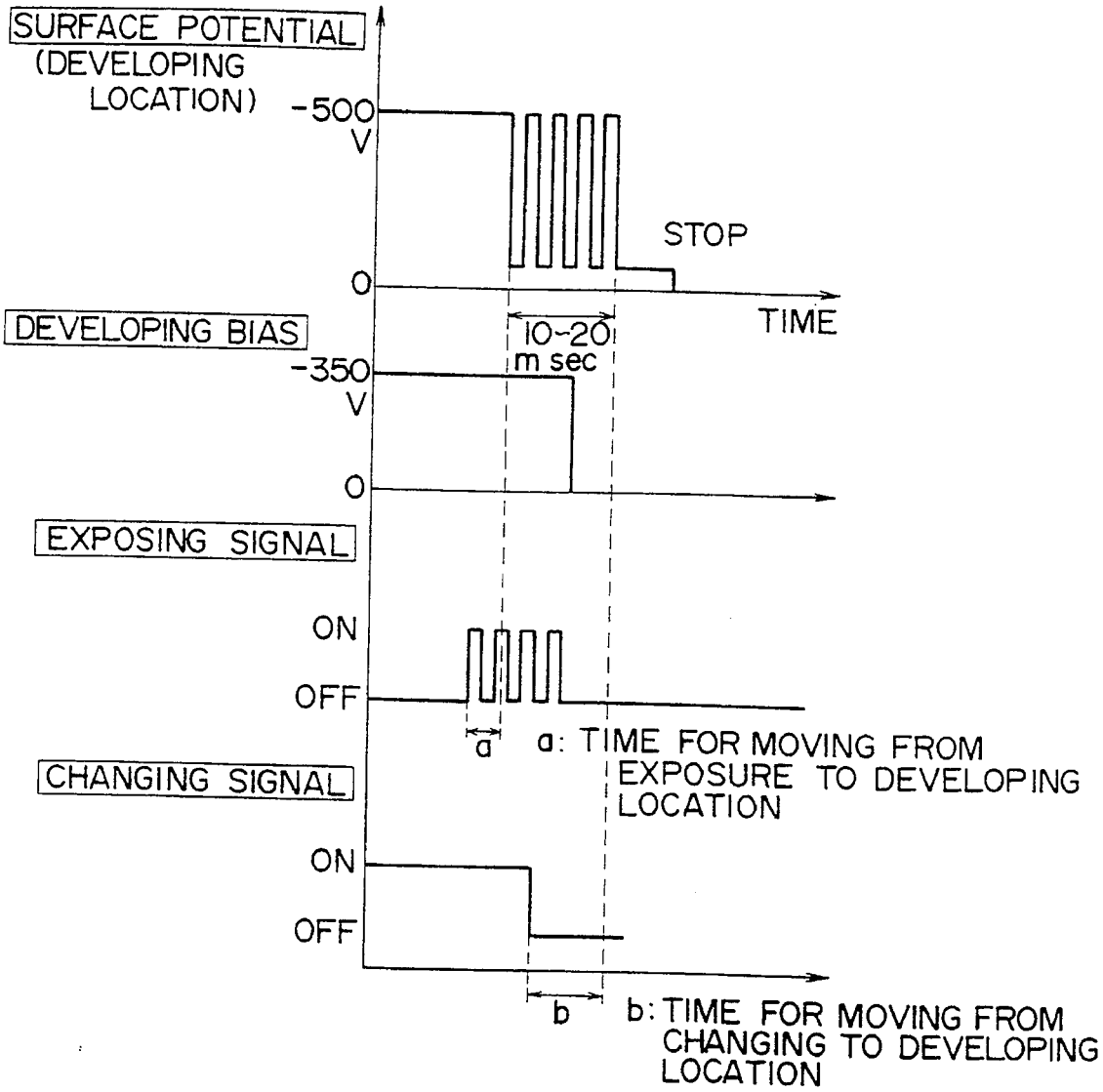
FIG. 10 is a timing chart showing an operation of a laser printer based on a control signal shown in FIG. 9.
Figure 11:
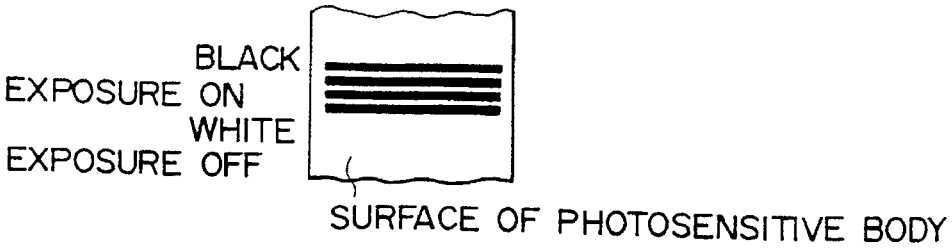
FIG. 11 is a concept view showing the state of exposure on the surface of a photosensitive body obtained by the operation of FIG. 10.

Next, the detailed flow will be discussed when the photosensitive body 1 is stopped. Viewing the flow of a signal in the invention as shown in FIG. 9, before stopping the photosensitive body, the CPU 101 sends a blinking signal to the LED 103 according to a pattern stored in a ROM 103. In this embodiment, a halftone image of an on/off signal per one line is used as shown in FIG. 11. Further, the CPU 101 sends an off signal to the DC (Developing) bias 104 and an off signal to the charging unit 105 and then sends an off signal to the motor control unit 106. The timing of each signal is predetermined by measurement and calculation so that the surface potential at the developing location may be as shown in FIG. 10.

In the printer for executing the above operation, the carrier and the toner attraction disappear so that they do not have an adverse effect on the transfer roller.

Figure 12A:
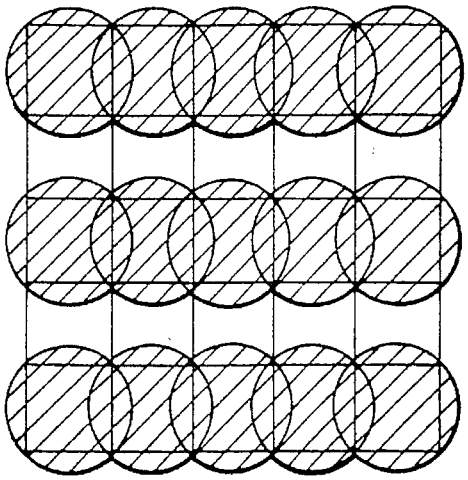
FIG. 12 is a view showing various kinds of exposure on the surface of the photosensitive body obtained by the laser printer shown in FIG. 8.
Figure 12B:
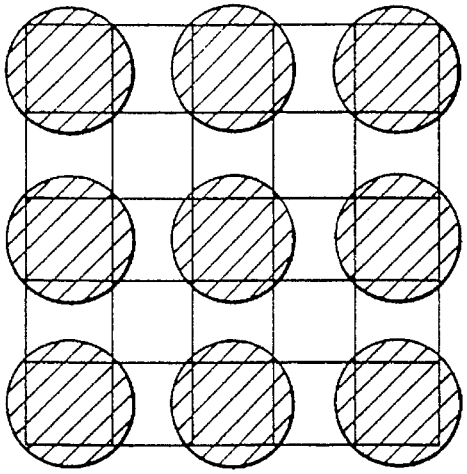
Figure 12C:
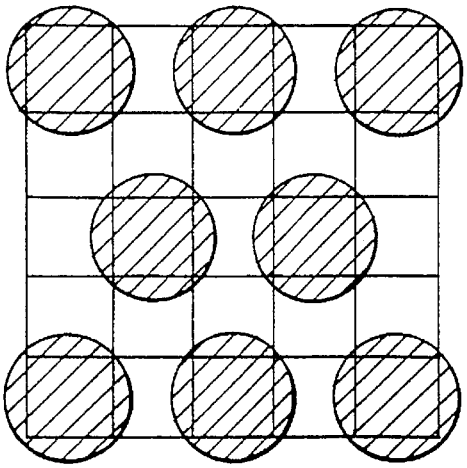
Figure 13:
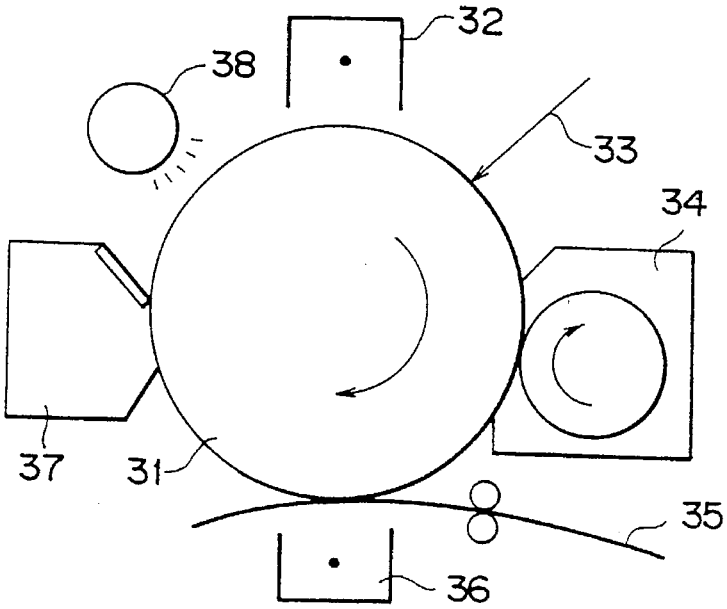
FIG. 13 is a view showing an arrangement around the photosensitive body based on the prior art.
Figure 14:
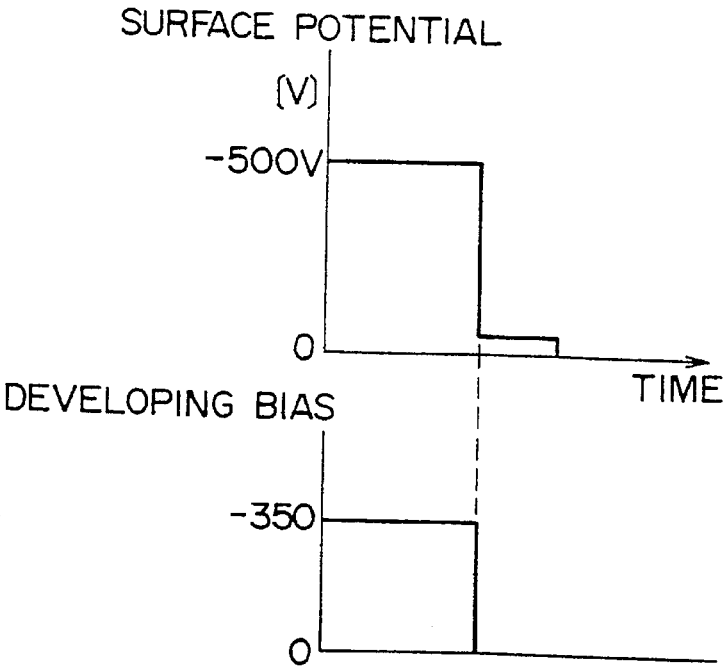
FIG. 14 is a view standing for an ideal timing relation between the surface potential of the photosensitive body and the developing bias potential.
Figure 15:
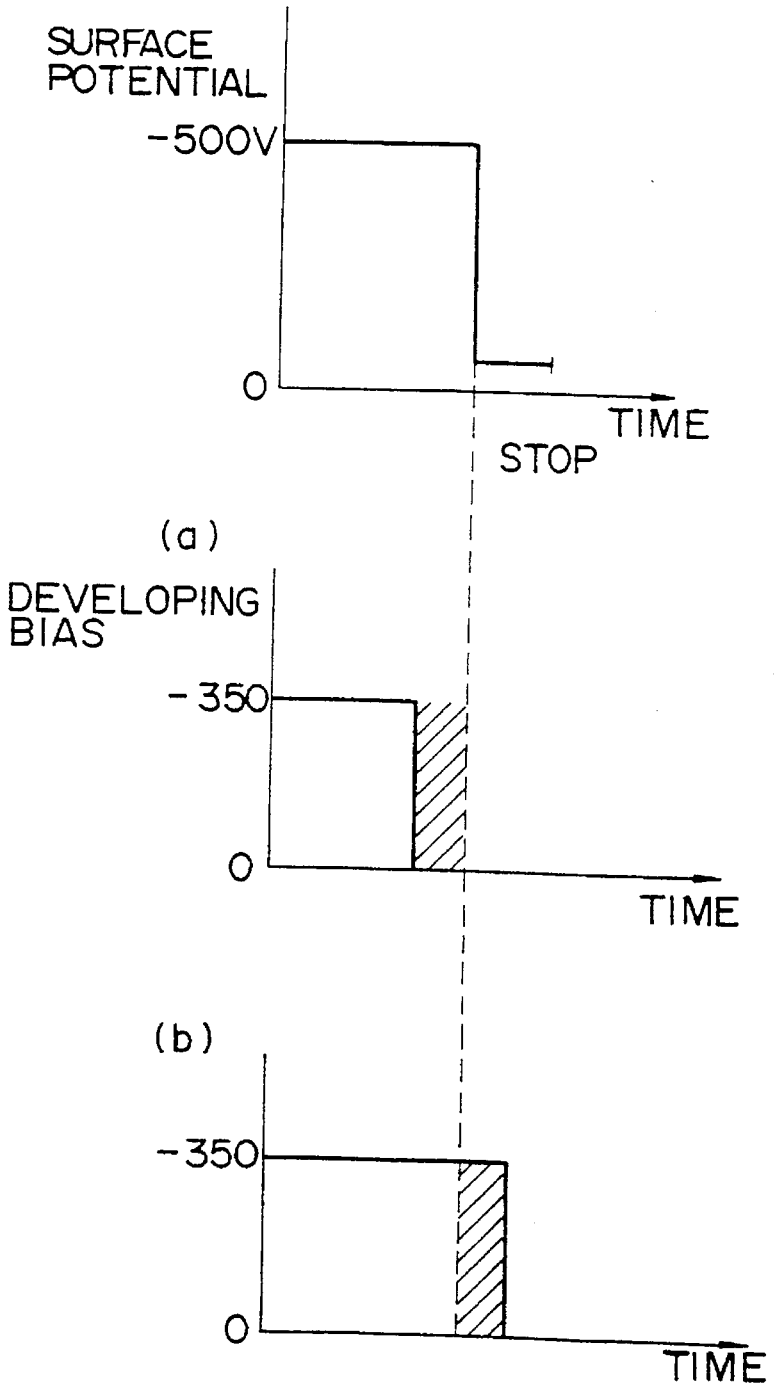
FIG. 15 is a view standing for a realistic timing of the prior art against the ideal relation shown in FIG. 14.

In another embodiment, the same effect can be obtained by the printer using a laser and a printer using no transfer roller. The blinking pattern used for discharging is not limited to the above embodiment. The laser printer provides a collection of dots so that a plurality of pseudo halftones may be produced by changing the locations of the dots. By expanding an on/off pattern per one line as shown in FIG. 11, the resulting format is as shown in FIG. 12-1. FIG. 12-2 shows the pattern formed by lowering the power on every other dots. FIG. 12-3 shows the pattern formed by lowering the power on zigzag dots. Further, it is possible to easily infer that the same result can be obtained by a plurality of patterns such as a one-line-on pattern and a two-line-off pattern.

Many widely different embodiments of the present invention may be constructed without departing from the spirit and the scope of the present invention. It should be understood that the present invention is not limited to the specific embodiments described in the specification, except as defined in the appended claims.

What is claimed is:

1. An image forming apparatus, comprising:

a photosensitive body having a photosensitive surface;

a main charger for charging said photosensitive body with a predetermined electric potential;

an exposing unit for applying a ray of light on said photosensitive surface to form an electrostatic latent image, including regulating means for regulating a power of said ray of light;

a developing unit for developing said electric latent image to form a toner image;

a transfer charger for transferring said toner image on an image transfer paper;

a power supply unit for supplying power to each of said main charger, said developing unit and said transfer charger; and control means for controlling said power supply unit after an image forming operation to raise an electric potential of said photosensitive body to a predetermined high level by said main charger, to lower the electric potential of said photosensitive body to a predetermined low level by said transfer charger and then to cut off a bias voltage of said developing unit, and for controlling said exposing unit after a control of said power supply unit to apply a regulated ray of light to said photosensitive body gradually enhancing said power of said ray of light to reduce carrier attraction and toner attraction.

2. An image forming apparatus according to claim 1, wherein said regulating means included means for switching the power of said ray of light in accordance with a characteristic of said photosensitive body or the time of use of said photosensitive body.

3. An image forming apparatus according to claim 1, wherein said regulating means includes means for changing a focal distance of said ray of light.

4. An image forming apparatus according to claim 1, wherein said regulating means includes means for changing a slit area through which said ray of light passes.

5. An image forming apparatus according to claim 1, wherein said regulating means includes a plate having a plurality of slits, each having different slit area, and rotating means for rotating said plate to change a slit area through which said ray of light passes.

6. An image forming apparatus according to claim 1, wherein said ray of light includes a laser beam.

7. An image forming apparatus according to claim 1, wherein said transfer charger is a contact type transfer charger.

* * * * *